United States Patent [19]

Fischer et al.

[11] Patent Number: 5,039,067

[45] Date of Patent: Aug. 13, 1991

[54] SYSTEM THAT EMPLOYS AIR TO COOL A METALLURGICAL VESSEL IN AN ANNULAR SUPPORT

[75] Inventors: Rudolf Fischer, Dorsten; Horst Willaschek, Oberhausen, both of Fed. Rep. of Germany

[73] Assignee: MAN Gutehoffnungshütte AG, Oberhausen, Fed. Rep. of Germany

[21] Appl. No.: 557,988

[22] Filed: Jul. 25, 1990

[30] Foreign Application Priority Data

Aug. 24, 1989 [DE] Fed. Rep. of Germany ..... 3927928

[51] Int. Cl.[5] ..... C21C 5/42

[52] U.S. Cl. ..... 266/241; 266/246

[58] Field of Search ..... 266/245, 246, 247, 241

[56] References Cited

U.S. PATENT DOCUMENTS 3,713,638 1/1973 Langmead et al. ..... 266/246

FOREIGN PATENT DOCUMENTS 0174311 8/1986 Japan ..... 266/246

*Primary Examiner*—S. Kastler

*Attorney, Agent, or Firm*—Max Fogiel

[57] ABSTRACT

A system that employs air to directly cool heat-accessible metallurgical vessels that are provided with separate annular supports, characterized in that air channels (6) are positioned on the outside of the annular support (5) with a number of air-injection pipes (7) distributed along the circumference and extending radially from the channels to the inner wall of the annular support, whereby outlets (8) slope up into the gap (3) between the annular support and the outer wall (1) of the metallurgical vessel, in that air is injected into the cooling system through one or both load-bearing connectors (4), and in that the difference in pressure within the system is less than 2000 mm $H_2O$ and the air travels at less than 25 m/sec.

3 Claims, 3 Drawing Sheets

SYSTEM THAT EMPLOYS AIR TO COOL A METALLURGICAL VESSEL IN AN ANNULAR SUPPORT

BACKGROUND OF THE INVENTION

The invention concerns a system that employs air to cool heat-accessible metallurgical vessels that are provided with separate annular supports.

Large-scale converters for producing steel and other heat-accessible metallurgical vessels, crucibles for example, are generally secured in an annular support separated by a gap of 100 mm or more.

Metallurgical vessels of this type can expand freely as the temperature increases. Still they are often so exposed to high tension and heat that they exceed their limits of expansion, resulting in permanent deformation of the vessel. Gradually and over the course of several years the vessel will expand to the extent that its surface comes into contact with the support, forces its way into it, or deforms it. Cracks may also occur in the surface of the vessel. The reason for this damage is that the pressure exerted by the vessel's fire-proof lining increases with temperature. Since the lining is considerably hotter than the surface of the vessel, the former tends to expand more powerfully than the vessel, even when the coefficient of expansion of the lining is approximately the same as that of the steel surface. Furthermore, as the lining wears down and becomes thinner, the temperatures of the surface will increase and the vessel will become weaker. These drawbacks are particularly severe in large vessels, the walls of which, because they are welded, cannot be as thick as desired.

Other problems can occur in situations for example when tiles with a high content of carbon are employed to prolong the life of the fireproof lining. Such tiles conduct heat especially well and can accordingly raise the temperature of the vessel's wall above the threshold of strength.

Whenever there is a risk of the pressure exerted by the lining and of the temperature of the vessel's surface exceeding permissible levels, the metallurgical vessel must be additionally cooled.

Cooling the conical converter hat at the top with water is known. Installing a water-employing cooling system in the gap between the wall of the vessel and the annular support is undesirable in practice, however, because it would make access to that area too difficult.

The vicinity of the annular support is accordingly preferably cooled with air. Known for example is an air-employing cooling system with what is called a pipe curtain inserted between the annular support and the vessel and blowing air radially onto the surface of the vessel through several evenly distributed individual nozzles.

This system has drawbacks that can be ascribed to the necessity of increasing the air pressure to attain adequate cooling. The nozzles occupy too much space between the annular support and the vessel. Furthermore, there is usually not enough space in an existing converter plant to install such a cooling system. Finally, the existing natural convection would be severely inhibited or even eliminated by the installation of such a system.

Another air-employing cooling system has an annular line below the annular support with nozzles aimed in from the side or up that inject air to augment the natural convection current. The drawback to this system, however, is that the cross-sections of the pipeline must be small enough for the pipe to fit in, meaning that the air absolutely must be compressed, and effective heat diversion requires too much compressed air. Furthermore, the comparatively small cross-sections of the piping employed in this system mean that it must make do with small volumes of air, resulting in only minimal cooling.

Also known, finally, is the uniform distribution of several steel rings along the circumference of a steel-mill converter to create, in conjunction with steel straps or strips of sheet metal, box-shaped channels to conduct the injected air.

SUMMARY OF THE INVENTION

The object of the present invention is to improve the air-employing cooling of heat-accessible metallurgical vessels that are provided with separate annular supports and to effectively eliminate deformation of the vessel.

The point of departure for the invention is that, since all the lines in the system that the cooling air flows through have a large enough cross-section to keep impedance low, only a little pressure will be necessary to maintain enough of a current to divert the heat.

Installing a cooling system in accordance with the invention will augment rather than impede the natural convection.

The space between the surface of the vessel and the annular support will remain free of intruding components. Access to all the air-conducting channels and pipes for cleaning and repair will be easy.

The outlets of the air-injection pipes will usually have no nozzles to get clogged up or damaged. A cooling system in accordance with the invention can also be easily installed in existing vessels that have heretofore been impossible to cool.

Installing or retaining a system for cooling an annular support itself by circulating water through its rectangular cross-section will not be impeded by the air-employing cooling system.

The effectiveness and efficiency of the cooling system in accordance with the invention as compared with a state-of-the-art systems will be evident from the pressure losses and associated fan outputs for a steel-mill converter charged with approximately 220 metric tons. Whereas a conventional air-employing cooling system loses approximately 3000 mm $H_2O$ and its fan consumes approximately 880 kW to maintain the surface of a converter at approximately 350°C., the cooling system in accordance with the invention loses a total of approximately 750 mm $H_2O$ and its fan consumes approximately 220 kW to maintain the same temperature.

BRIEF DESCRIPTION OF THE DRAWINGS

The invention will now be described in detail by way of the example of a steel-mill converter with reference to the schematic drawings, wherein.

DESCRIPTION OF THE PREFERRED EMBODIMENTS

Figure 1:
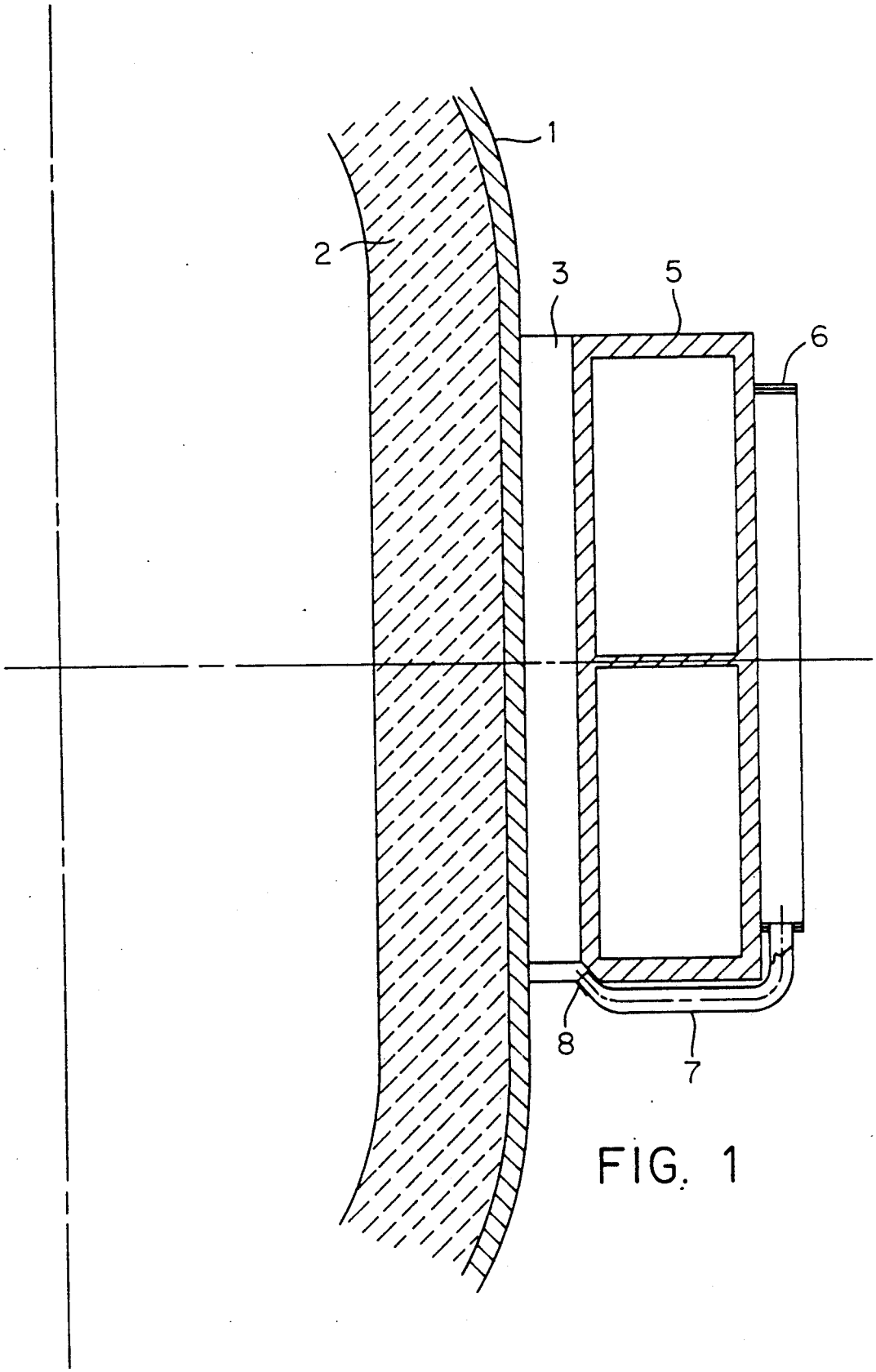
FIG. 1 is a vertical section through the annular support and part of a converter with an air-employing cooling system in accordance with the invention.
Figure 2:
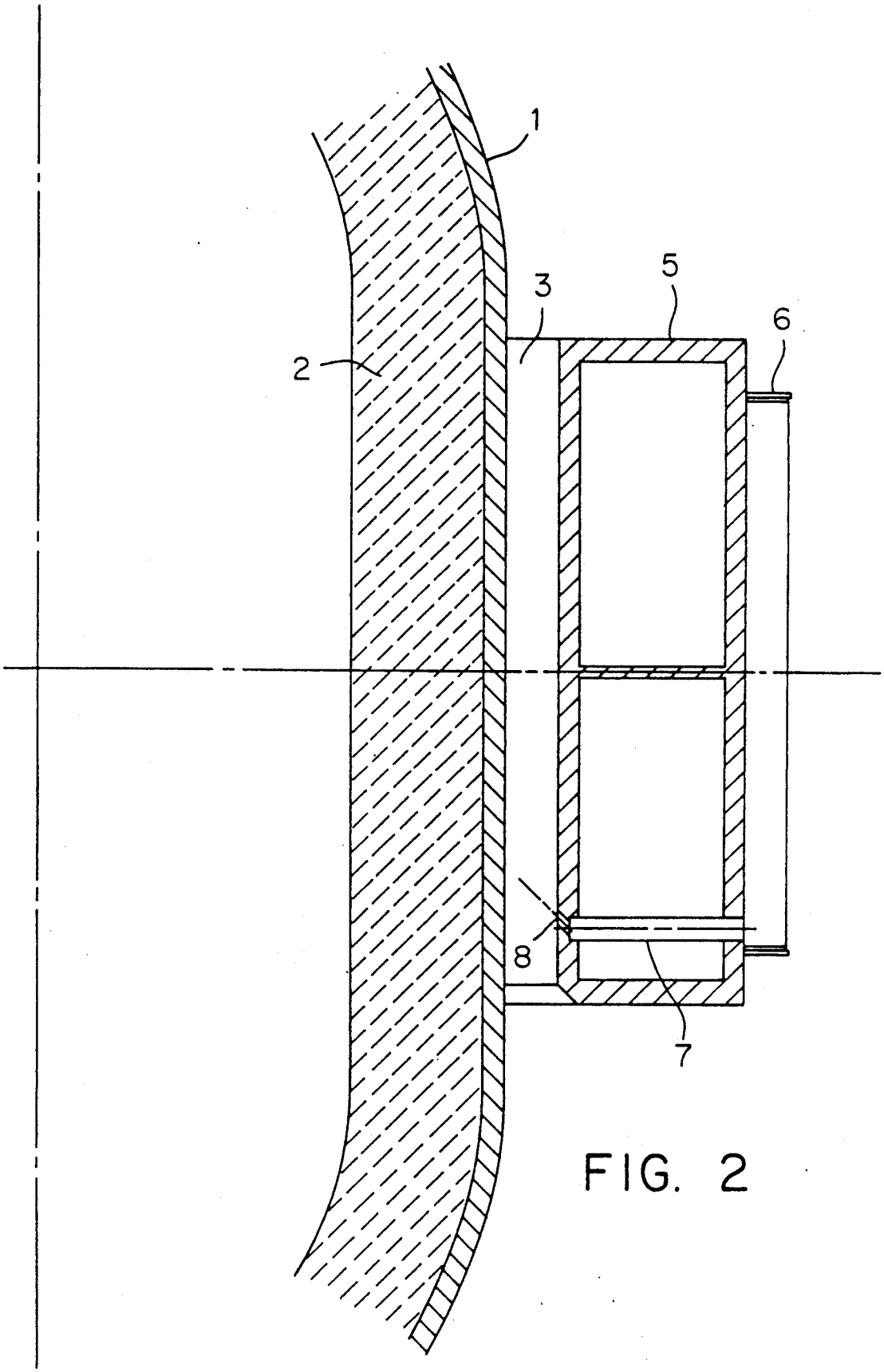
FIG. 2 is a vertical section like that in FIG. 1 with a different type of injection pipe.

FIGS. 1 and 2 illustrate the wall 1 of a converter with a fireproof lining 2. Wall 1 is separated from an annular support 5 by a gap 3.

Annular support 5 is surrounded by a sheet-metal air channel 6 with a quadrilateral cross-section. Branching out from the bottom of air channel 6 and uniformly distributed along its circumference are several air-injection pipes 7 that parallel the bottom of annular support 5 and extend toward gap 3. Approximately 50 such pipes will be distributed around the converter, depending on its size.

The outlets 8 from air-injection pipes 7 are at an angle of approximately 45° to wall 1. The outlets are usually not provided with nozzles.

Air is injected by an unillustrated fan through a load-bearing connector 4, air channels 6, and air-injection pipes 7. Since the air leaving the pipes enters the gap 3 between annular support 5 and wall 1 at an upward angle, it will augment the natural convection.

FIG. 2 illustrates an air-employing cooling system with air-injection pipes 7 that extend through annular support 5 with their outlets in the inner wall of the support. Outlets 8 are bored in the inner wall of the support and are aimed at an upward angle and toward wall 1.

The air-employing cooling system with air-injection pipes 7 in accordance with the invention illustrated in FIG. 1 is also appropriate for installation in an existing metallurgical vessel.

Figure 3:
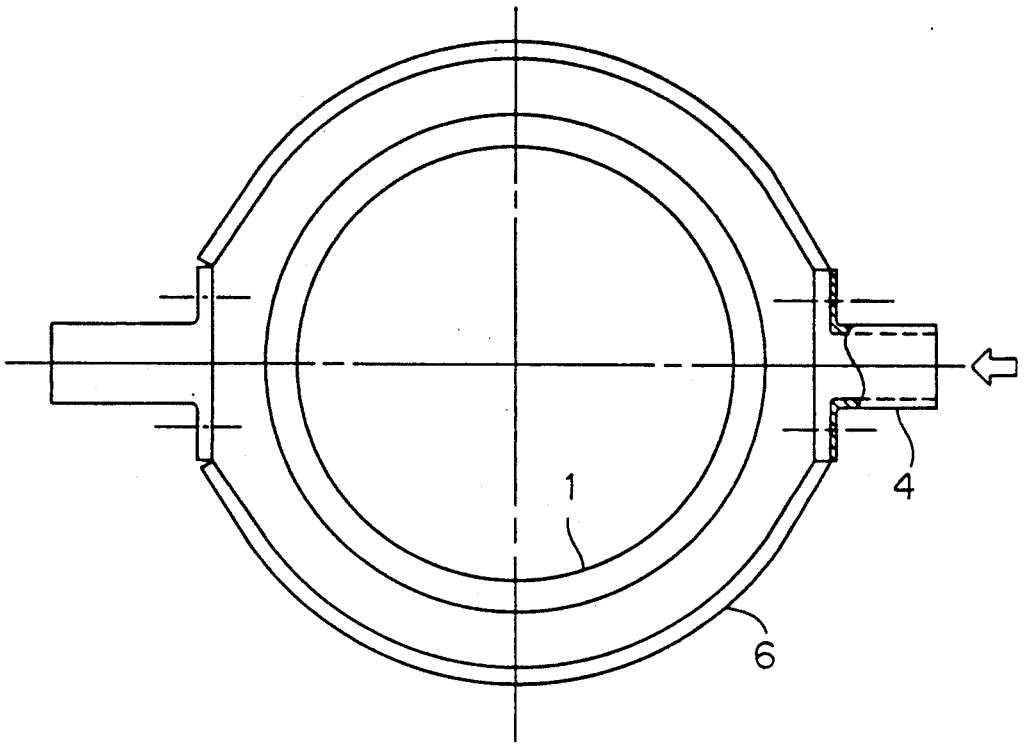
FIG. 3 is a top view of the converter with air injected through one load-bearing connector.
Figure 4:
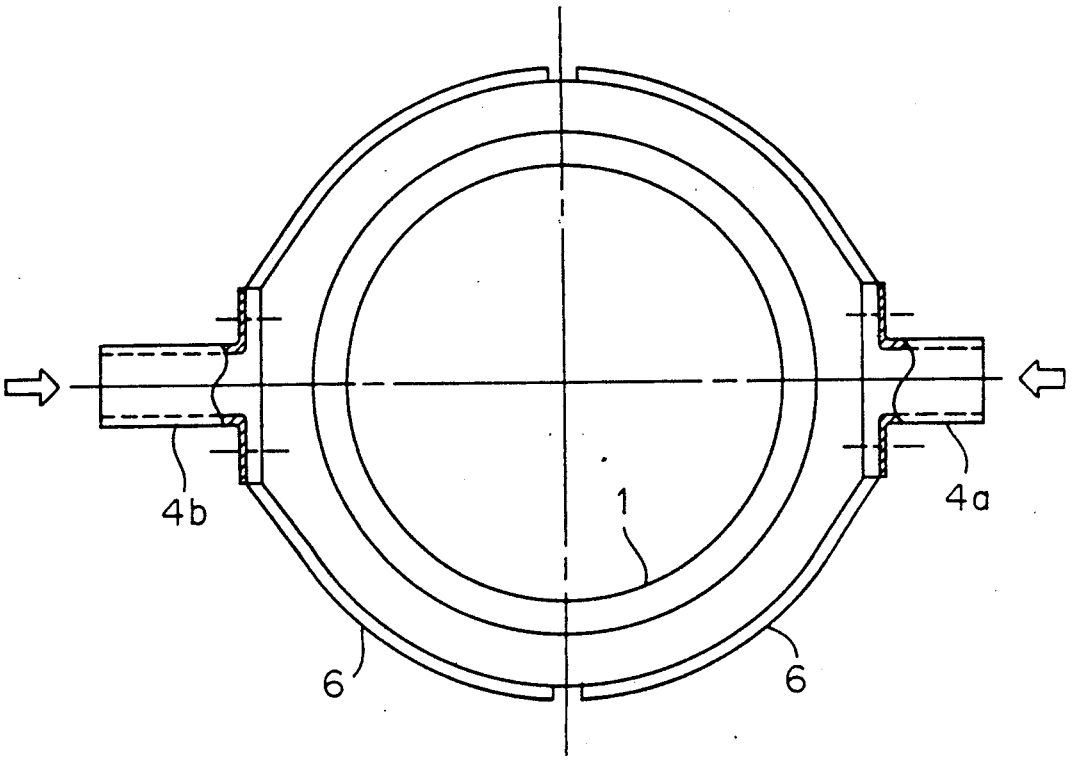
FIG. 4 is a top view like that in FIG. 3 with air injected through both connectors.

From FIG. 3 it will be evident (from the arrow) that the air is injected into the cooling system through only one connector 4, whence it is distributed by way of air channels 6 positioned along the circumference of annular support 5.

The air is injected (in the directions indicated by the arrows) into the cooling system by way of both a movable-bearing support 4*a* and an actuating-mechanism bearing support 4*b*. This air-employing cooling system is accordingly in two parts, with half the circumference of the vessel being supplied with air by each pin. Air channels 6 are accordingly interrupted halfway around the circumference.

We claim:

1. An arrangement for cooling heat-accessible metallurgical vessels, comprising: a plurality of metallurgical vessels; a separate loose annular support for each vessel; box-shaped air channel means having a substantially large cross-section and being of steel metal construction around the outside periphery of said annular support; said metallurgical vessel having an outer wall spaced by a gap from an inner wall of said annular support; a plurality of air-injection blow pipes of substantially large diameter distributed along a circumference of said air channel means and extending radially from said channel means to said inner wall of said annular support; said air-injection blow pipes having outlets sloping up into said gap between said annular support and said outer wall of said vessel, said outlets being free of nozzles; load-bearing connector means on said air channel means for conducting injected air into said air channel means and into said cooling arrangement, said cooling arrangement having interior means with an interior pressure differing from atmospheric pressure by less than 2000 mm $H_2O$, said outlets of said air-injection pipes emitting air at a speed less than 25 m/sec.

2. An arrangement as defined in claim 1, wherein said air-injection pipes extend through said annular support.

3. An arrangement as defined in claim 1, wherein said air-injection pipes extend around a lower side of said annular support.

* * * * *